United States Patent [19]

Van Elderen et al.

[11] Patent Number: 4,807,886

[45] Date of Patent: Feb. 28, 1989

[54] AMUSEMENT GAME WITH DISPENSED TARGETS

[75] Inventors: Daniel N. Van Elderen, Los Altos Hills; Gerald J. Lichac, Santa Cruz, both of Calif.

[73] Assignee: Atari Games, Milpitas, Calif.

[21] Appl. No.: 95,600

[22] Filed: Sep. 11, 1987

[51] Int. Cl.[4] ..... A63F 9/02; F41J 9/00

[52] U.S. Cl. ..... 273/356; 124/6; 273/368; 273/393

[58] Field of Search ..... 273/355, 356, 368, 393; 124/1, 6, 78

[56] References Cited

U.S. PATENT DOCUMENTS

| | | | |
|---|---|---|---|
| 24,031 | 5/1859 | Joslin | 124/6 |
| 1,611,814 | 12/1926 | Butler . | |
| 2,006,955 | 7/1935 | Kolar | 273/368 |
| 2,845,055 | 7/1958 | Collins et al. . | |
| 3,009,703 | 11/1961 | Jentsch et al. . | |
| 3,034,785 | 5/1962 | Graham . | |
| 3,548,801 | 12/1970 | Lohr et al. | 124/6 |
| 4,025,071 | 5/1977 | Hodges . | |
| 4,185,824 | 1/1980 | Natwick . | |
| 4,225,140 | 9/1980 | D'Andrade et al. . | |
| 4,559,918 | 12/1985 | Ballerin et al. . | |

FOREIGN PATENT DOCUMENTS

| | | | |
|---|---|---|---|
| 2384515 | 11/1978 | France | 273/393 |
| 5324 | of 1894 | United Kingdom | 273/393 |

*Primary Examiner*—Anton O. Oechsle

*Attorney, Agent, or Firm*—Ciotti & Murashige, Irell & Manella

[57] ABSTRACT

A Gattling-gun-like amusement game provides for manual control of the rate of firing and dispensing of dislodged targets as prizes to the player. The gun fires balls at round targets supported on rotating carousels. Dislodged targets roll to the front of an enclosure for dispensing to the player. The balls are separated and fed by an Archimedes' spiral to a feed tube connected to the gun. A sensor is used with controls to limit the number of balls provided to a player. The balls are fed through two successive nip regions formed by pinch rollers. The first is manually controlled by a crank to vary the rate of firing. Balls delivered from the first nip region are fired at high speed by a fast rotating, fixed speed second pinch roller.

16 Claims, 4 Drawing Sheets

AMUSEMENT GAME WITH DISPENSED TARGETS

FIELD OF THE INVENTION

This invention relates to amusement games, and in particular to amusement games having a target which is dispensed to a player.

BACKGROUND OF THE INVENTION

Many forms of amusement games have been developed. In a common form of game, objects are balanced at the end of a gallery. Balls are then thrown at the objects. The balls are manually returned to the players and prizes are manually awarded based on which objects are dislodged.

In another form of game, guns direct a light beam at an object with a photosensitive detector. Prizes are then in the form of additional shooting time or are manually delivered.

In another form of game as disclosed in U.S. Pat. No. 3,034,785 issued to Graham, players ride in a revolving vehicle carrying guns which are used to shoot at targets. The projectiles are in the form of balls which are recycled through the gun after collection at the bottom of the flying chamber. No prizes are provided in this game.

In none of these games is a gun used to dislodge a target from a support by a directed projectile. In particular, in none of them is the target the prize which is delivered to the player when dislodged from a support. Further, in none of them is the prized automatically provided to the player.

SUMMARY OF THE INVENTION

The present invention provides an amusement game which overcomes these limitations of the prior art. In particular, it provides an amusement game in which a player may direct or project a projectile toward a target. It also preferably provides an game wherein a target contacted in a predetermined manner by a projectile is automatically delivered to the player as a prize.

In particular, the present invention provides an amusement game comprising a target and a support for the target which allows the target to be contacted in a predetermined manner by a moving object. Means are also provided for directing or projecting a projectile toward the target so that the projectile is contacted in the predetermined manner. The invention also preferably provides a target which can be dislodged when contacted in a predetermined manner and means for transporting a dislodged target to a delivery station for recovery by a player.

These and other objects and advantages of the present invention will become apparent from a review of the drawings and the following detailed description of the preferred embodiment.

DETAILED DESCRIPTION OF THE PREFERRED EMBODIMENT

Figure 1:
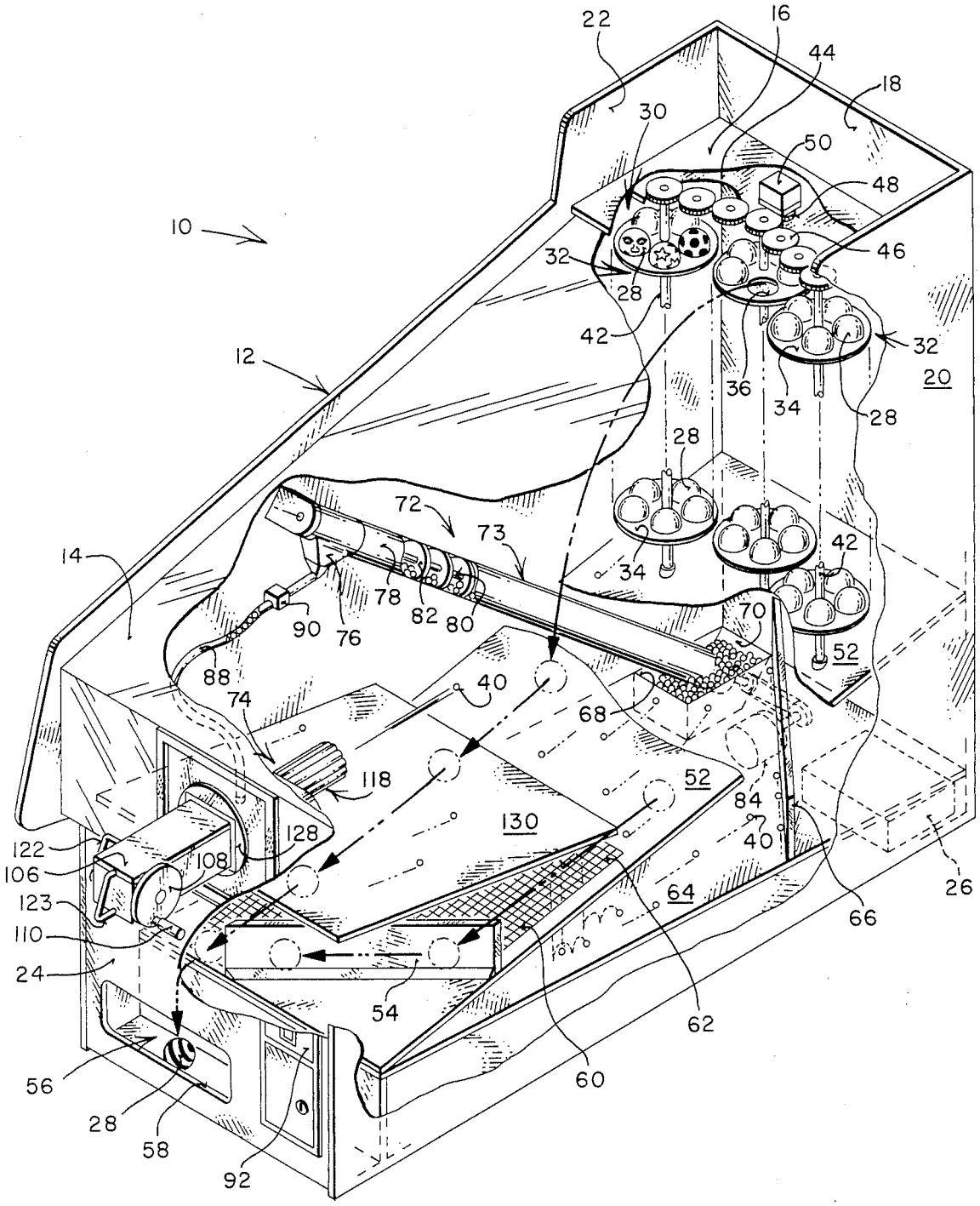
FIG. 1 is a partially fragmented, perspective view of an amusement game made according to the present invention.
Figure 2:
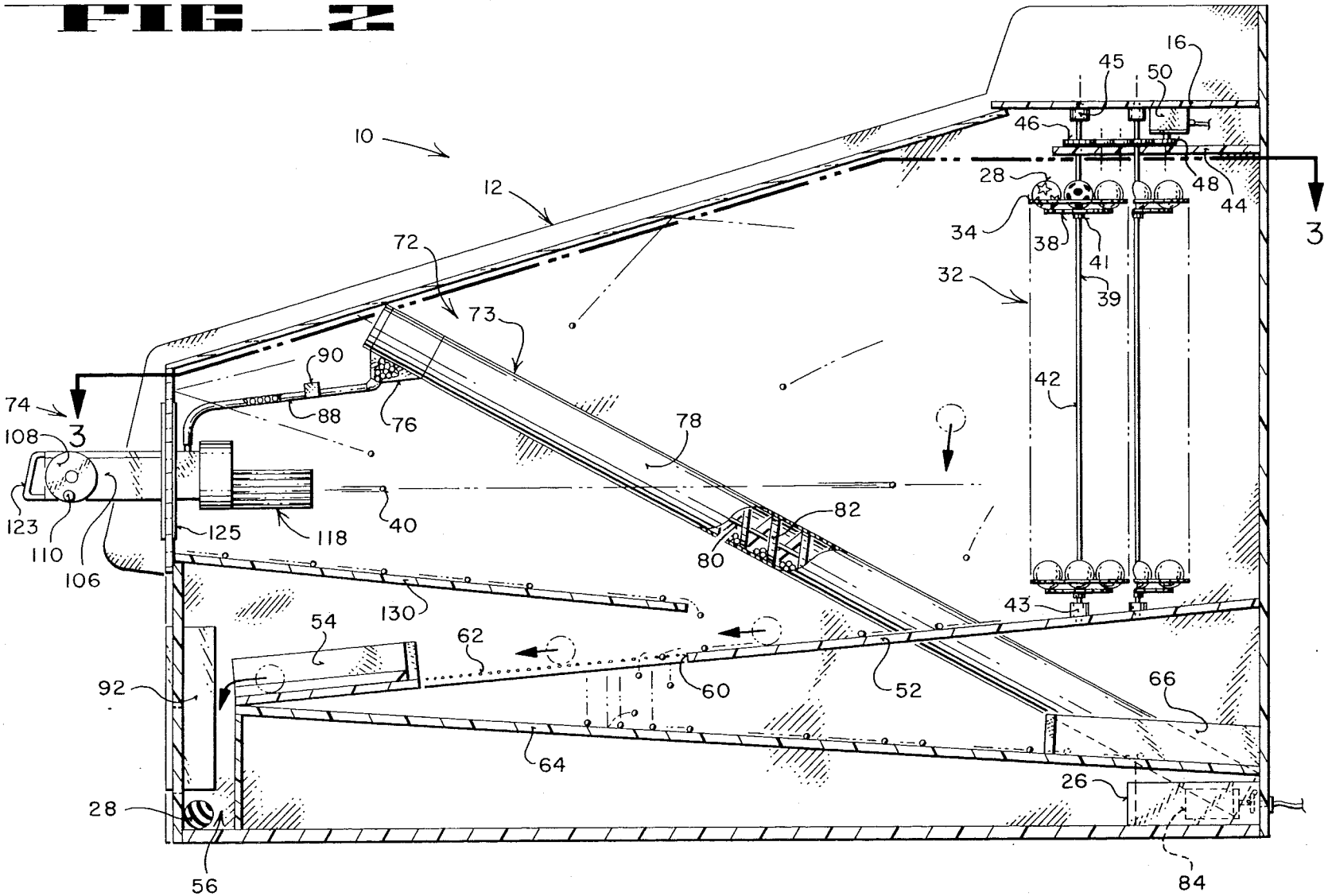
FIG. 2 is a side view in cross section of the game of FIG. 1.
Figure 3:
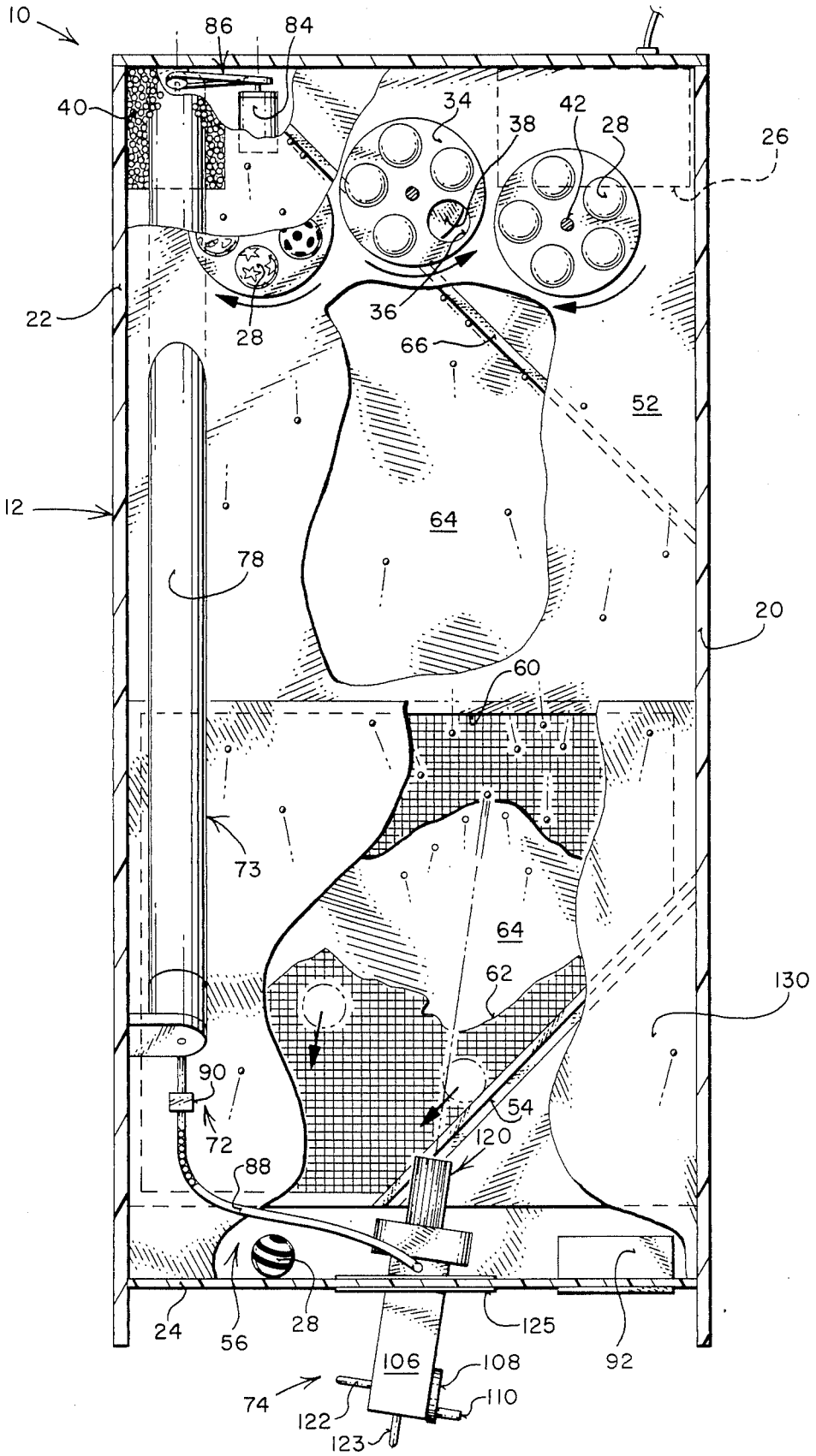
FIG. 3 is a cross-sectional view taken along line 3—3 in FIG. 2.

Referring initially to FIGS. 1, 2 and 3, an amusement game made according to the present invention is shown generally at 10. Game 10 includes an enclosure 12 having a top clear, impact resistant plastic cover 14 which slopes downwardly toward the front or left end as viewed in the figures. The enclosure also includes a top rear panel 16, a rear panel 18, side panels 20 and 22, and a front panel 24. A power supply and controls are located in a box 26 located in the rear lower section of the unit.

The game includes a plurality of targets 28 which also become prizes when they are dislodged from their supports, shown generally at 30. Each target 28 is preferably made of a resilient material, such as rubber, are preferably round, and are desirably decorated in an attractive manner, such as with geometric designs or with the images of unusual faces. The targets are supported on one of three carousels, such as carousel 32 which has a plurality of circular discs 34, each having five openings, such as opening 36.

The openings are sized approximately the same as the outer diameter of the targets. The bottom of the targets rest on the edge of reduced sized discs 38 disposed just below discs 34. A target can be dislodged or removed from opening 36 by impacting appropriately the side of the target with a series of projectiles or balls 40. The force required to remove a target from its support in the discs is determined by how high in opening 36 it is positioned as controlled by how close disc 38 is to disc 34. Disc 38 is made adjustable by mounting the disc to rod 42 by a set screw 39 in a sleeve 41. The sleeve is attached to the disc and slidable relative to the rod which passes through it.

Carousel 32 is completed by a vertical rod 42 which extends through the center of discs 34 and 38. The discs are fixedly mounted to the rod. The bottom of the rod rides on a bearing 43. The top of the rod extends up to another bearing 45 attached to top rear panel 16. Each rod passes through an intermediate cover panel 44 where it is fastened to a gear 46, as shown. A series of seven such gears 46 are intermeshed with three of them being mounted on rods 42. The intermediate gears are simply idler gears mounted on panel 44. The middle gear 46 is rotatably driven by a drive motor 50 via a gear 48 meshing with middle gear 46. Motor 50 causes the carousels to rotate at about ten revolutions per minute. The particular speed of rotation is not important except that it should be slow enough to allow a player to be able direct a series of balls at a single target as the target moves.

Targets which are dislodged from the carousel drop to a target delivery board 52 which has a slope forward and downward. The targets being generally round, roll under the force of gravity toward the front of enclosure 12. A diversion board 54 is disposed in a generally vertical plane and at an angle relative to the sides of the enclosure to divert targets rolling along the right side of board 52 toward the front left corner, as viewed from front panel 24. The targets end up adjacent front panel 24 in a target dispensing station 56. An opening 58 extends through panel 24 in the lower left portion to provide access by a player to targets dislodged from the carousel and delivered to station 56.

An opening 60 disposed across board 54 is covered by a screen 62 having a mesh sized to allow balls 40 to drop through it but small enough to prevent targets 28 from dropping through. Thus, the screen acts as means for separating the balls from the targets.

The balls returning on board 52 which have been fired at targets supported on a carousel drop through screen 62 to a ball return board 64 sloping downward to the rear. Similar to target diversion board 54, a ball diversion board 66 is disposed in a vertical plane and angled at 45 degrees across the rear right corner of board 64. Returning balls are thus diverted into an opening 68 disposed in the left rear corner of board 64.

Returning balls drop through opening 68 into a box 70 which fills with the balls. A ball transfer system 72 transfers the balls from box 70 to a Gattling-like gun 74 which is used to direct the balls toward supported targets. Transfer system 72 includes an Archimedes' spiral 73 having a lower end disposed in box 70 where balls are captured and delivered at its opposite end to a funnel 76.

Transfer system 72 includes an outer straight tube 78 supported on an internal, axially disposed rod 80 on which the tube is supported at its opposite ends. Disposed against the inside surface of tube 78 is a spiral 82 sized to support balls as the tube is turned to transfer them to the top in an Archimedes' spiral fashion. Rod 80 is controllably rotated by a motor 84 via a pulley system 86.

Balls delivered to the top of tube 78 are delivered to a gun feed tube 88 via funnel 76. Disposed on the feed tube adjacent the funnel is a photodiode-based ball sensor 90. This sensor keeps track of the balls which travel past it in the tube. By conventionally known means, when a desired number of balls have been delivered to the feed tube and gun, motor 84 is turned off to prevent further balls from being transferred to the feed tube. The specific count of balls is determined by the amount of money fed into a coin receptacle 92 mounted in the front of the enclosure adjacent the handle of the gun.

Figure 4:
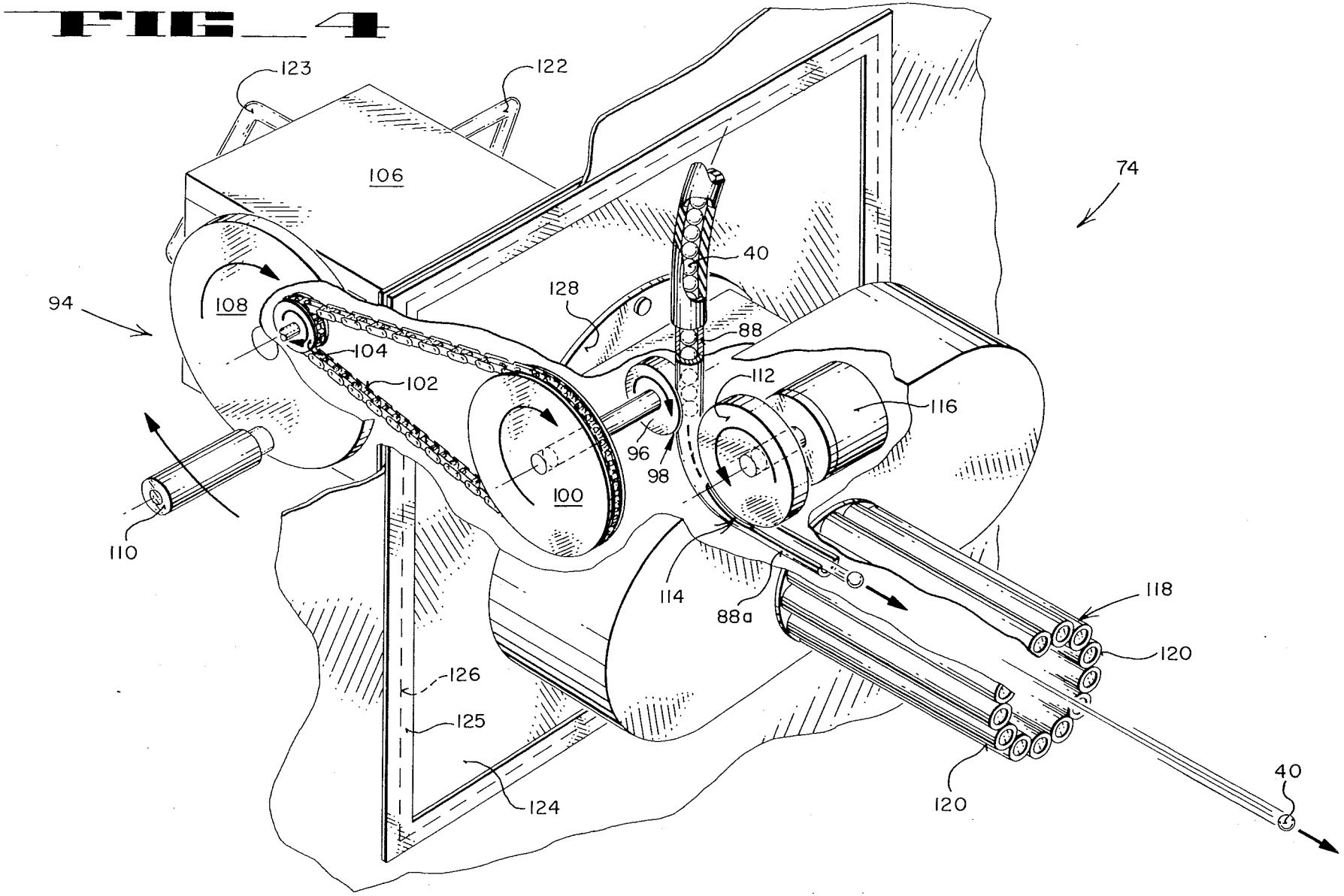
FIG. 4 is a perspective view of the projectile feed and projecting mechanism of the game in FIG. 1.

Referring now particularly to FIG. 4, gun 74 is shown in further detail. Travel of a ball is controlled by a manually operated ball feed apparatus 94. Apparatus 94 includes a rotatable resilient pinch-roller 96 which extends into a portion of tube 88 to form a nip region 98. Region 98 is formed so that balls 40 cannot travel down tube 88 unless roller 96 rotates to move each ball through the nip region.

Roller 96 is attached to a sprocket wheel 100 which is drivingly connected by a loop chain 102 to a drive sprocket wheel 104. Wheels 100 and 104 are rotatably mounted relative to a gun housing 106 which extends forwardly from front panel 24 of enclosure 12. Fixedly attached to wheel 104 is a crank wheel 108 positioned externally of housing 106. Crank handle 110 is attached along its periphery to wheel 108. The rotation of wheel 108 by crank handle 110 causes pinch-roller 96 to rotate at a corresponding rate. Thus, the crank can be used to completely control the feeding of balls along tube 88. If the crank is held in a fixed position, no balls are fed down the tube. If it is rotated quickly, a rapid series of balls is fed.

Balls released by roller 96 drop by gravity down an extension of tube 88 to a second pinch-roller or firing wheel 112 which also extends along its periphery into tube 88, creating a second nip region 114. Wheel 112 is rotated at 3000 rpm by a connected driving motor 116. During operation of game 10, motor 116 is constantly running so that as soon as a ball is released from nip region 98, it enters nip region 114 and is directed or projected at a high rate of speed along the end **88*a* of the feed tube. End 88*a* extends into a large barrel 118 formed of circumferentially disposed smaller tubes 120 which give the appearance of a multi-barrel Gatling-type gun. The balls actually travel out through the center of large barrel 118**.

Opposite from crank wheel 108 on housing 106 is fixedly mounted a handle 122 which serves as a force countering and gun steadying support for the player operating gun 74. An alternate support handle 123 is disposed on the end or butt of housing 106 as shown. Housing 106 is attached to front panel 24 by a resilient rubber diaphragm 124 held in place by a clamping frame 125. Diaphragm 124 is clamped to the margins of a rectangular opening 126 located in front panel 24. The diaphragm has a central opening (not shown) in it through which housing 106 extends and to which the housing is in turn clamped by a pair of plates 128.

Diaphragm 124 is sufficiently thick to support the gun while allowing the gun to be rotated relative to front panel 24. The diaphragm thus acts as a universal joint for pivoting the gun during aiming at the various targets during use. The diaphragm also acts as a barrier to prevent balls ricocheting in enclosure 12 from escaping from the enclosure. It also prevents tampering with the internal components of gun 74 by players using it.

A final ball return board 130 which slopes downwardly to the rear is positioned in enclosure 12 below gun 74. This board extends to a position over the rear edge of screen 72 so that balls deflected to the front of enclosure 12 are returned to a region of board 54 where they will roll into the screen.

Summarizing operation of amusement game 10, in a ready condition, feed tube 88 is filled with balls 40 and carousels 32 are loaded with a variety of targets 28. When coins are inserted into coin receptacle 92, motor 50 is turned on, causing the carousels to rotate, and motor 116 in gun 74 is turned on. The player then begins firing balls 40 by rotating crank handle 110 at a desired rate to release balls to nip region 114. By firing balls in rapid succession by quickly rotating the crank handle, a plurality of balls can be directed at a single target. The direction of the projected balls is controlled by the player by pivoting the gun as desired. The cumulative momentum of the balls on the target, preferably against a lower surface of the round targets shown, unseats it from disc 38 and dislodges it from larger disc 34. With continued use of the gun, a player develops skill in aiming it and knowing where to hit the targets and how many hits are required to dislodge them. Thus, a skilled player is able to select a desired prize and more consistently dislodge it with fewer balls than is required by a less experienced player. The rate of awarding prizes is therefore directly proportional to the skill level of the player.

The dislodged target drops to target delivery board 52 on which it rolls up to dispensing station 56 for pickup by the player. Balls fired at the target also fall to board 52. However, instead of traveling to the front of the board, they drop through screen 62 to ball return board 64. The balls collect in box 70 where they are captured by Archimedes' screw 73 to be transferred to funnel 76 and feed tube 88. The number of balls delivered to the gun is controlled conventionally by circuitry in control box 26 based on the number of coins used.

It will thus be seen that an amusement game is provided wherein the player is able to control the rate of firing at targets and is able to dislodge targets which are then dispensed to the player as prizes. Although a single embodiment has been described, it will be appreciated that other variations in form and detail may be made in the embodiments without departing from the spirit and scope of the invention as defined in the claims.

We claim:

1. An amusement game comprising:

a target;

means for supporting said target in a manner allowing said target to be contacted in a predetermined manner by a moving object;

a plurality of projectiles;

means for projecting said projectiles toward said target so that said projectiles contact said supported target in a predetermined manner;

manually operable means for controlling the rate of projecting projectiles by said projecting means, said controlling means including a manually rotatable crank and projectile feeder means, said feeder means including a feed tube for receiving said projectiles and a roller disposed rearwardly of said projecting means contacting said projectiles in said feed tube and connected to said crank for rotation thereby, wherein said projectiles are forcibly fed to said projecting means at a variable rate dependent upon the rate at which said crank is rotated; and means for transporting a target contacted by a projectile in the predetermined manner to a delivery station for recovery by a player.

2. A game according to claim 1 wherein each said projectile is sized to dislodge said target when the projectile contacts the supported target in the predetermined manner, and said transporting means transports a dislodged target.

3. A game according to claim 2 wherein said target is structured to travel down a predetermined incline by gravitational force, said transporting means including such a predetermined incline.

4. A game according to claim 1 wherein said means for projecting is for projecting said plurality of projectiles serially.

5. A game according to claim 4 wherein it takes a series of contacts by a plurality of successively projected projectiles to dislodge said target.

6. A game according to claim 1 wherein said target is generally round.

7. A game according to claim 1 wherein said supporting means supports said target at peripherally spaced locations.

8. An amusement game, comprising:

a target;

means for supporting said target in a manner allowing said target to be contacted in a predetermined manner by a moving object;

a projectile;

means for directing said projectile toward said target so that said projectile contacts said supported target in a predetermined manner; and means for transporting a target contacted by a projectile in the predetermined manner to a delivery station for recovery by a player;

wherein said supporting means supports said target at peripherally spaced locations; and wherein said supporting means includes loop means sized to receive said target and a support disposed under said loop means on which said target rests.

9. A game according to claim 8 wherein the spacing between said support and loop means is adjustable.

10. A game according to claim 1 further comprising means for moving said target relative to said projecting means.

11. A game according to claim 10 wherein said moving means moves said supporting means, and thereby moves said target.

12. A game according to claim 11 wherein said supporting means includes a rod relative to which said target is supported, said moving means rotating said rod.

13. A game according to claim 1 further comprising means for separating a dislodged target from a projected projectile.

14. A game according to claim 13 wherein said target and said projectile are generally round and of different sizes, said separating means including screen means having an opening sized to allow passage therethrough of the smaller of the target and projectile and to prevent passage therethrough of the larger of the target and projectile.

15. An amusement game comprising:

a generally round target;

loop means for supporting said target in a manner allowing said target to be dislodged when contacted in a predetermined manner by a moving object;

a plurality of generally round projectiles sized to dislodge said target when the projectile contacts the supported target in the predetermined manner;

means for projecting serially said projectiles toward said target so that said projectiles are capable of contacting the supporting target in the predetermined manner;

means for controlling manually the rate of projecting projectiles by said projecting means, said controlling means including a manually rotatable crank and projectile feeder means, said feeder means including a feed tube for receiving said projectiles and a roller disposed rearwardly of said projecting means contacting said projectiles in said feed tube and connected to said crank for rotation thereby, wherein said projectiles are forcibly fed to said projecting means at a variable rate dependent upon the rate at which said crank is rotated;

incline means disposed at an appropriate angle relative to horizontal for transporting a dislodged target to a delivery station for recovery by a player; and means for moving said target relative to said projecting means.

16. A game according to claim 15 further comprising a vertically disposed panel for supporting said controlling means and projecting means, said panel having an opening through which said controlling means and projecting means extend, and resilient means mounted on said panel for supporting said controlling and projecting means in a manner allowing pivoting of said controlling and projecting means.

* * * * *